US008459168B2

(12) United States Patent
Hirschberg et al.

(10) Patent No.: US 8,459,168 B2
(45) Date of Patent: Jun. 11, 2013

(54) SEMI-FABRICATED ARMOR LAYER, AN ARMOR LAYER PRODUCED THEREFROM AND METHOD OF PRODUCTION THEREOF

(75) Inventors: Yoav Hirschberg, M.P. Merom Hagalil (IL); Idan David, Yaacov M. (IL); Ofer Medem, Kfar Vradim (IL)

(73) Assignee: Plasan Sasa Ltd, M.P. Marom Hagalil (IL)

( * ) Notice: Subject to any disclaimer, the term of this patent is extended or adjusted under 35 U.S.C. 154(b) by 0 days.

(21) Appl. No.: 13/155,416

(22) Filed: Jun. 8, 2011

(65) Prior Publication Data

US 2011/0232471 A1 Sep. 29, 2011

Related U.S. Application Data

(62) Division of application No. 12/081,173, filed on Apr. 11, 2008, now Pat. No. 7,958,811.

(30) Foreign Application Priority Data

Apr. 12, 2007 (IL) ..... 182511

(51) Int. Cl.
*F41H 1/02* (2006.01)

(52) U.S. Cl.
USPC ..... 89/36.05; 89/908; 89/917

(58) Field of Classification Search
USPC ..... 89/36.02, 36.01, 36.05, 903, 906, 89/917, 908, 909; 2/2.5; 428/116–119
See application file for complete search history.

(56) References Cited

U.S. PATENT DOCUMENTS

| | | | | |
|---|---|---|---|---|
| 3,523,057 | A | 8/1970 | Buck | |
| 3,705,558 | A | 12/1972 | McDougal et al. | |
| 3,867,239 | A * | 2/1975 | Alesi et al. | 428/48 |
| 4,538,301 | A * | 9/1985 | Sawatzki et al. | 2/467 |
| 4,810,559 | A * | 3/1989 | Fortier et al. | 428/161 |
| 5,028,469 | A * | 7/1991 | Costard | 428/73 |
| 5,677,029 | A * | 10/1997 | Prevorsek et al. | 428/113 |
| 5,738,925 | A | 4/1998 | Chaput | |
| 5,763,813 | A | 6/1998 | Cohen et al. | |
| 5,972,819 | A | 10/1999 | Cohen | |
| 5,996,115 | A | 12/1999 | Mazelsky | |

(Continued)

FOREIGN PATENT DOCUMENTS

| | | | |
|---|---|---|---|
| DE | 39 40 623 | A1 | 6/1991 |
| EP | 0 611 943 | A1 | 8/1994 |
| EP | 0 699 887 | A2 | 3/1996 |
| EP | 1 521 051 | A1 | 4/2005 |
| EP | 1 522 817 | A1 | 4/2005 |
| EP | 1 705 453 | A1 | 9/2006 |
| EP | 1 734 332 | A2 | 12/2006 |
| GB | 2 272 272 | A | 5/1994 |
| WO | 00/47944 | | 8/2000 |
| WO | 03/057462 | A1 | 7/2003 |

*Primary Examiner* — Michael Carone
*Assistant Examiner* — Reginald Tillman, Jr.
(74) *Attorney, Agent, or Firm* — Workman Nydegger

(57) ABSTRACT

Provided is a semi-fabricated armor layer for use in the production of an armor panel configured to protect a body from an incoming projectile, including a carrier and a plurality of armor elements. Each armor element has front and rear end surfaces and a side surface extending therebetween along a height axis of the element. The carrier is flexible and each of a majority of the armor elements is bonded to the carrier at one of its end surfaces and is free of bonding to adjacent armor elements at its side surface. When the carrier has a planar orientation, at least a majority of the armor elements has their height axes essentially parallel to each other and, when the carrier is at least slightly bent, the height axis of at least one of the elements is inclined relative to the height axis of another of the armor elements adjacent thereto.

18 Claims, 7 Drawing Sheets

U.S. PATENT DOCUMENTS

| | | | | |
|---|---|---|---|---|
| 6,035,438 | A * | 3/2000 | Neal et al. | 2/2.5 |
| 6,500,507 | B1 * | 12/2002 | Fisher | 428/36.1 |
| 7,866,248 | B2 * | 1/2011 | Moore et al. | 89/36.02 |
| 7,958,811 | B2 | 6/2011 | Hirschberg et al. | |
| 8,069,494 | B2 * | 12/2011 | Sundnes | 2/2.5 |
| 2003/0167910 | A1 | 9/2003 | Strait | |
| 2004/0020353 | A1 | 2/2004 | Ravid et al. | |
| 2006/0065111 | A1 | 3/2006 | Henry | |
| 2007/0034074 | A1 | 2/2007 | Ravid et al. | |
| 2008/0289087 | A1 | 11/2008 | Sundnes | |
| 2009/0078109 | A1 | 3/2009 | Baxter et al. | |
| 2009/0126557 | A1 | 5/2009 | Hunn | |
| 2009/0145289 | A1 | 6/2009 | Cohen | |
| 2010/0071537 | A1 | 3/2010 | Weber et al. | |

* cited by examiner

SEMI-FABRICATED ARMOR LAYER, AN ARMOR LAYER PRODUCED THEREFROM AND METHOD OF PRODUCTION THEREOF

This is a Divisional Application filed under 35 U.S.C. §120 as a division of U.S. patent application Ser. No. 12/081,173, filed on Apr. 11, 2008, which was a Non-Provisional Application claiming the benefit under 35 U.S.C. §119 of Israeli Patent Application No. 182511, filed on Apr. 12, 2007, the content of each of which is hereby incorporated by reference in its entirety.

FIELD OF THE INVENTION

This invention relates to ballistic armor, in particular to an armor comprising a layer of pellets made of high density material, adapted to provide protection against armor piercing projectiles directed thereto.

BACKGROUND OF THE INVENTION

Ballistic armor of the above type requires a design allowing the armor to have low weight and high ballistic protection. This consideration derives from the fact that the armor is normally to be carried either by a person, or by a vehicle to be protected.

The construction of ballistic armor using ceramic pellets in one of its layers is well known in the field. In most cases, the pellets are embedded in a layer or matrix of material which may be resin, rubber etc. Such armors prove to be very efficient and have high multi-hit capabilities due to the fact that impact of a projectile on one ceramic pellet, or several adjacent ceramic pellets does not essentially affect the pellets surrounding the impact area. This is contrary to monolithic armors in which impact on one spot reflects on the entire monolith.

U.S. Pat. No. 5,763,813 discloses multi-layered armor comprising an outer, impact-receiving layer produced as a panel consisting of a single internal layer of high density ceramic pellets retained in panel form by a solidified material, for deforming and shattering an impacting high-velocity, armor-piercing projectile; and an inner layer adjacent to said outer layer, comprising a tough woven textile material for causing an asymmetric deformation of the remaining fragments of said projectile and for absorbing the remaining kinetic energy from said fragments.

WO 00/47944 discloses a ballistic panel comprising a carrier member and a plurality of cylindrical bodies made of a high density material, the bodies being attached to the carrier member at one end thereof by an adhesive, wherein two neighboring bodies are in contact with one another along their generatrix, i.e. having their longitudinal axes parallel to one another, or wherein three neighboring bodies are attached to an intermediate filler body positioned therebetween.

US 20070034074 discloses a composite armor panel comprising a main layer of pellets in a binder matrix, and front and back layers bonded thereto by a method in which forming the main layer and bonding the front and back layers thereto are performed simultaneously. The method comprises providing the front and back layers, applying binder material to the pellets and the layers and heating the binder material to form the matrix and bind the front and back layers thereto. The method described in US 20070034074 comprises providing a mold of dimensions corresponding to those of the armor plate to be produced, disposing the mold horizontally, arranging the front layer in the interior of mold and along the side walls to form a cavity having sides and a bottom, filling the cavity with pellets in closely packed arrangement with their front ends facing said bottom, introducing in the mold the binder so as to fill all the spaces between the pellets and the bottom and sides of the cavity and to cover the pellets' rear ends, covering the rear ends of the pellets with the back layer, and applying heat to the mold and pressure to the back layer. Such method of production facilitates the application of pressure to the plate and ensures improved contact between the front ends of the pellets and the front layer, and the back ends of the pellets and the back layer, increasing confinement, due to which ballistic protection provided by the armor is improved. Furthermore, the use of ballistic fabric for the front and back layers allows for the binder material to be absorbed therein, which increases the ballistic protection capability of the armor plate.

SUMMARY OF THE INVENTION

According to one aspect of the present invention there is provided a semi-fabricated armor layer for use in production of an armor panel adapted to protect a body from an incoming projectile (threat). The armor panel and method of its production may, for example, be as described in US 20070034074, the description of which is incorporated herein by reference, where the semi-fabricated armor layer is used to form the armor panel's main layer.

The semi-fabricated layer of the present invention comprises a carrier and a plurality of armor elements each having front and rear end surfaces and a side surface extending therebetween along a height axis of the element, wherein said carrier is flexible and each of a majority of said armor elements is bonded to said carrier at one of its end surfaces and is free of bonding to adjacent armor elements at its side surface so that, when said carrier has a planar orientation, e.g. when the semi-fabricated layer is disposed on a planar surface, at least a majority of the armor elements has their height axes essentially parallel to each other and, when the carrier is at least slightly bent, the height axis of at least one of said elements is inclined relative to the height axis of another of the armor elements adjacent thereto. In other words, due to the flexibility of the carrier, the armor elements on said carrier are movable with respect to each other by changing the orientation of one portion of the semi-fabricated layer relative to its other portion, by virtue of which bonded end surfaces of at least two adjacent armor elements will not be co-planar though staying in close proximity to each other—whilst their non-bonded end surfaces will be essentially spaced from each other.

The material from which the carrier is made may be in the form of a carrier grid defined by a pattern of lines and the bonded end surface of each of a majority of said elements may be bonded to the carrier at least at two of said lines. The carrier grid may be any appropriate woven or non-woven fiber net. In case of a woven material, the carrier grid may be made in a weft and warp manner.

The material from which the carrier grid is made may be flexible or may be adapted to become flexible during the fabrication of said semi-fabricated armor layer, by subjecting it to appropriate temperature and pressure conditions.

According to various embodiments of the present invention, the carrier grid may be a substantially pliable sheet of continuous material. Said sheet may be made of various materials, e.g. fabric, ballistic fabric, bonding substance etc.

The carrier grid may have a relatively light weight, high tensile strength and high thermal resistance. To have a light weight, the carrier grid may have a relatively low density of its lines, which may for example be not greater than six parallel lines per cm of the carrier grid, particularly not greater than four parallel lines per cm, and still more particularly, not greater than three parallel lines in one cm of the carrier grid, and/or it may be as light as 100 g/m$^2$ or even less. The tensile strength of the carrier grid should be such as to allow the grid of a predetermined size, when held at two opposite edges to carry the weight of the armor elements bonded thereto, without being plastically deformed. Thus, for example, the tensile strength of the carrier grid may be in the range of 60÷140 N per five cm wide strip of carrier grid, particularly 80÷120 N per five cm, and still more particularly, it may be as high as 100 N per five cm. Furthermore, the carrier grid may be characterized by different warp and weft tensile strength, which may be beneficial with respect to manufacturing and shaping of the armor panel. The thermal resistance of the carrier grid may be such as to enable it to withstand high temperature (at which the armor elements are bonded to the carrier or at which the semi-fabricated layer will be bonded to other layers, when an armor panel is produced therefrom) without undergoing substantial mechanical or chemical changes, for example shrinking. Thus, the material may be designed to withstand the temperatures at which bonding substance used in its production acquires its liquid form, for example temperatures as high as 150° C., particularly 140° C. and still more particularly 130° C.

The carrier grid may be pre-produced with the bonding substance impregnated therein. Alternatively, the grid may be adapted for spreading of the bonding substance thereon in a dry form, e.g. in the form of a film, or in a liquid form, before the armor elements are bonded thereto.

The bonding substance may be in the form of any suitable thermoplastic resin. The amount of the bonding substance present in the semi-fabricated armor layer may be relatively low such that, in the areas between adjacent armor elements bonded thereby, the substance when is held by the lines of the carrier grid, leaving gaps therebetween free of the bonding substance. For example, the amount of bonding substance in the semi-fabricated armor layer the may be 30÷70 g/m2, and more particularly, between 35÷55 g/m2, and still more particularly between 40÷50 g/m2.

The material of the carrier grid and the bonding substance should be such that they do not loose their above discussed properties in the process of production of an armor panel using the semi-fabricated layer. Moreover, when incorporated in such armor, they normally should at least not deteriorate the ballistic effectiveness of the armor.

The armor elements may be made of various ballistic materials, for example, of high density ceramics such as alumina, and may be in the form of pellets of various shapes, for example, any regular shape such as rectangular, spherical, cylindrical, or the like. The armor elements may be of various sizes, for example, in case of cylindrical pellets, the diameter and height of the cylindrical pellet may vary according to required ballistic characteristics of the armor. Thus, the range of ratio H/D between the height H and diameter D of the pellets may be 1/10÷2/1, in particular 1/5÷5/3, and still more particularly 1/4÷4/3. The cylindrical pellets may have their front end surfaces convex, and their rear end surfaces flat.

In the semi-fabricated armor layer as described above, in which the pellets are attached to the carrier only at their one end and the carrier and hence the armor layer is flexible, the semi-fabricated armor layer, when incorporated in an armor panel, may take on a non-planar shape. In addition, the semi-fabricated armor layer may be foldable along at least one folding line such as to allow its armor elements on two sides of, and adjacent to, the folding line, to have their bonded end surfaces facing each other. In this way, the semi-fabricated armor layer may be folded over and over for space-efficient storage. Said semi-fabricated armor layer may even be rolled due to its flexible characteristics to take on a substantially cylindrical rolled up shape. The folded/rolled semi-fabricated armor layer, and may remain in a folded state until it is required for the manufacture of the armor panel. It should be noted that the semi-fabricated armor layer may remain in such stored state for a considerably long time, i.e. weeks and even months, without loosing its shape or breaking up the predetermined pattern of the pellets.

Although the material used for the carrier is adapted to withstand considerable tensile strength as described above, it may still be easily cut, even by standard means, e.g. scissors. Thus, the carrier may be cut through, allowing the shaping of the semi-fabricated armor layer after its production to substantially any desired shape. The semi-fabricated armor layer may also be pre-designed to have a specific shape according to the shape of the armor panel in which it is to be incorporated; for example, for an armor of a vehicle it may take on the shape of the vehicle door.

The semi-fabricated armor layer may also constitute a part of a kit adapted for the manufacturing of armor panels for a specific need. For example, the kit may be provided for manufacturing armor panels for various vehicle parts and comprise a semi-fabricated armor layer in the shape of a left-side vehicle door, a right-side vehicle door, an engine hood and front wind-shield.

Alternatively, the semi-fabricated armor layer may be produced in the form of modular units, allowing the future user to construct, using said modular units, a larger semi-fabricated armor layer of a desired shape. The modular units may be constructed such that the pellets disposed along an edge of a first modular unit fit between the pellets disposed on an edge of a second modular unit, so that when arranged adjacent each other, they create a uniformly tessellated surface.

According to another aspect of the present invention, there is provided a method for manufacturing a semi-fabricated armor layer of the kind described above, comprising:

a) providing a carrier made of material;

b) providing a plurality of armor elements, each having front and rear end surfaces and a side surface extending therebetween along a height axis of the element; and c) bonding said armor elements to said carrier in a predetermined pattern, at one of said end surfaces of each element, keeping the elements' side surfaces free of bonding to adjacent armor elements;

wherein said material from which the carrier is made is flexible at least after the armor element has been bonded thereto so that, when said carrier has a planar orientation, at least a majority of the armor elements has their height axes essentially parallel to each other and, when the carrier is at least slightly bent, the height axis of at least one of said elements is inclined relative to the height axis of another of the armor elements adjacent thereto.

Each pellet may be partially or entirely coated with primer. Hereinafter, the term "primer" is to be understood as a coating material adapted to facilitate bonding of the bonding substance to the pellet and carrier. The primer may be applied to the pellets before or after their arrangement on the carrier. The pellets may also be fully coated with said primer.

As previously explained, said pellets are only bonded to said carrier grid through a contact area, constituting a part of said front or said rear face of the pellets. The ratio 's' between size of said contact area and the size of the end surface bonded to the carrier grid, may be controlled by specific parameters of the bonding process, and may range from being about 1/10 to 1/1.

In accordance with a still further aspect of the present invention there is provided an armor panel comprising a main layer and a backing layer, said main layer being produced from a pre-fabricated semi-fabricated armor layer including an flexible carrier and armor elements each having front and rear end surfaces and a side surface extending therebetween along a height axis of the element, each of a majority of said armor elements in said pre-fabricated layer being bonded to said carrier at one of its end surfaces, said elements in said armor panel being bonded to the backing layer at their other end surfaces.

The above armor panel may be produced by a process during which the armor elements' end surfaces non-bonded to the carrier of the semi-fabricated layer are bonded to the backing layer and armor elements' side surfaces are bonded to each other, providing the armor panel with an essential rigidity. The armor panel may further comprise a front layer which may constitute a portion of a wrapping, and it may be produced by a method comprising:

a) providing a mold of dimensions corresponding to those of the armor panel;
b) disposing the mold horizontally;
c) arranging a front layer in the interior of mold and along the side walls to form a cavity having sides and a bottom;
d) placing said semi-fabricated armor layer within said cavity, with said carrier and front end surfaces of the armor elements thereof facing said front layer;
e) introducing in the mold the bonding substance so as to fill all the gaps between the pellets and the bottom and sides of the cavity and to cover the rear end surfaces of the armor elements;
f) covering the rear end surfaces of the armor elements with at least one backing layer; and
g) applying heat and pressure to the mold.

The above method of production facilitates the application of pressure to the plate and ensures appropriate bonding of the front end surfaces of the armor elements and the carrier to which they are bonded to the front layer, and provides an improved contact between the rear end surfaces of the armor elements and said backing layer, increasing confinement of the layers within the wrapping, due to which ballistic protection provided by the armor is improved.

The wrapping and the backing layer may be made of one or more sub-layers of ballistic fabric, which allows the bonding substance to be absorbed therein, thereby increasing the ballistic protection capability of the armor panel. If the bonding substance is introduced as a liquid, the heat should be sufficient to cure it. When it is introduced in a powder form, the heat should be sufficient to melt the powder.

According to certain embodiments of the present invention, said semi-fabricated armor layer may be used for the manufacture of a substantially flexible armor, the manufacture of which involves tightly wrapping said semi-fabricated armor layer in ballistic fabrics. Such flexible armor may require no additional bonding of the semi-fabricated layer to the wrapping, subjection to heat and temperature etc, thereby maintaining the armor flexible due to the flexible characteristics of said semi-fabricate armor layer and material from which the wrapping is made.

According to a specific design embodiment, each armor element used in the armor described above may be in the form of a pellet having a domed front face and a body portion merging with the front face along a perimeter line, the domed front face having a juncture point and being formed of sectors, each defined between two side edges have the form of arcs and a portion of the perimeter line extending between two spaced-apart points lying thereon, and constituting the sector's base edge, each side edge spanning between the juncture point and one of the spaced apart points; the shape of each sector being such that:

a) the intersection of the sector and a first plane crossing said two side edges, has a form of a straight line extending therebetween; and
b) the intersection of the sector and a second plane crossing said base edge, has a form of a convexly curved line;

wherein the front layer is made of a material other than the binder matrix and is bonded to at least the majority of the pellets at the domed front faces thereof.

When the pellets have an axis of symmetry (e.g., rotational symmetry) passing through the juncture point, the second plane may contain the axis of symmetry and the first plane may be substantially perpendicular to the second plane, being parallel to the axis of symmetry.

The second plane may substantially bisect each sector, i.e., bisect the angle formed between the two side edges defining it. The second plane may further be perpendicular to the base edge of each sector.

The juncture point may be the outermost point of the front face of the pellet, i.e., it is farther from the body portion than any other point of the front end.

The convexly curved line formed by the intersection of the sector with the second plane may be a circular arc having a first radius, and each of the side edges may be circular arcs having a second radius which is greater than the first radius. Due to this geometry, the front face of the pellets may be seen as being fully disposed within an imaginary sphere having the second radius, except for the side edges defining this sphere.

The perimeter line may be defined by an inscribed circle lying in a plane, e.g., it may fully lie in the plane, and the side edges of the sectors may be oriented such that a line tangent to each of the side edge at the juncture point lies in a plane which is parallel to this plane.

The body portion may be in the form of a polygonal cylinder having a plurality of sides, each side merging with the domed face at the base edge of one of the sectors. Alternatively, the body portion may have any other shape, i.e., that of a circular or oval cylinder, and this shape, or dimensions of the body portion, may vary along its axis of symmetry.

The polygonal cylinder may have a convex polygonal shape and may have any number of sides, e.g. have four sides, e.g. be a square cylinder, or six sides, e.g. be a hexagonal cylinder. In the latter cases, the sides of the polygonal cylindrical body portion of the pellet may be planar. Pellets with such body portions are known, for example, from EP 699887 and DE 102005013660. However, the use of pellets with the hexagonal body portions in the semi-fabricated layer of the present invention, when the pellets are arranged side by side with their adjacent planar sides aligned with and facing each other, provides the semi-fabricated layer with an improved stability, both when in planar configuration and when folded.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF EMBODIMENTS

Figure 1:
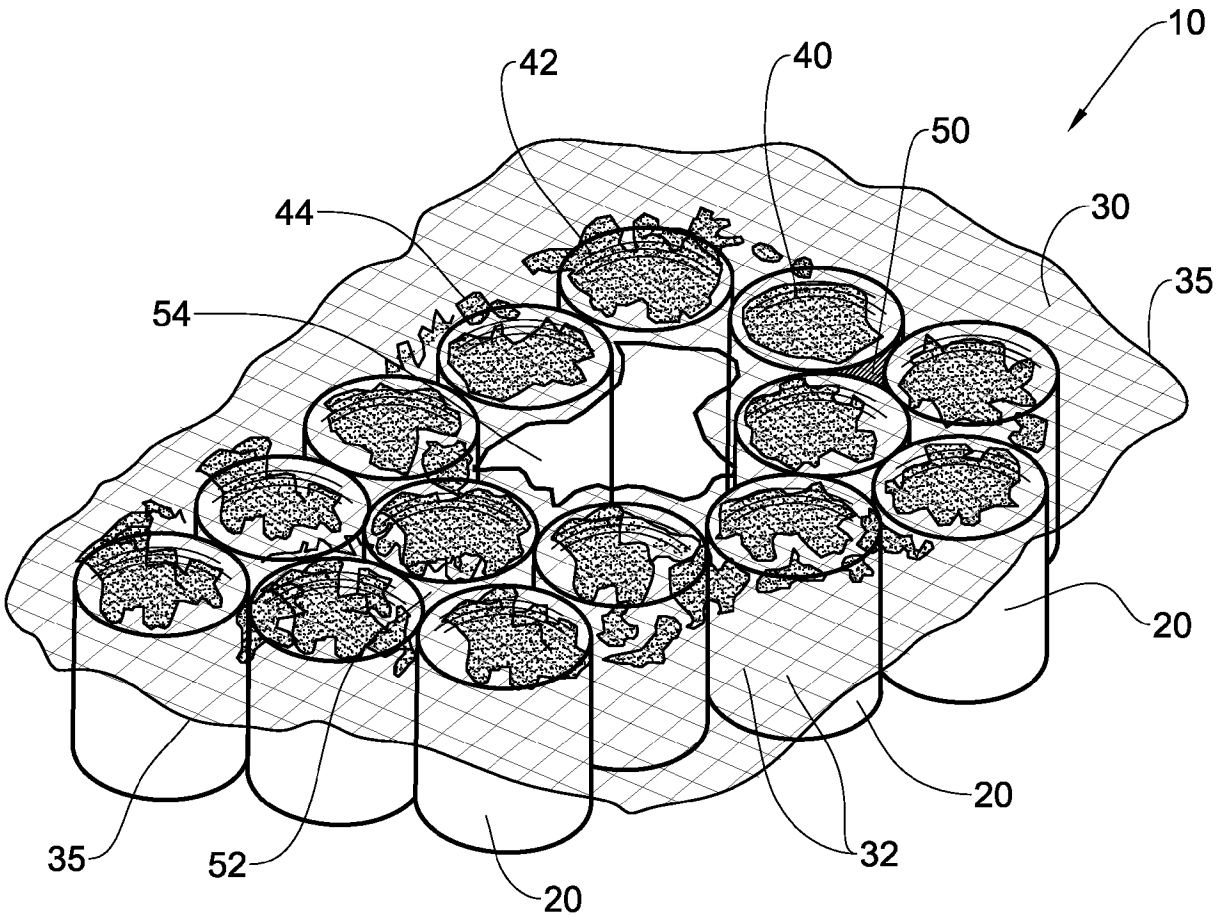
FIG. 1 is a schematic perspective view of a semi-fabricated armor layer according to one embodiment of the present invention.

FIG. 1 shows one example of a semi-fabricated armor layer 10 of the present invention, adapted for being used in the production of an armor panel such as for example disclosed in US 20070034074.

The semi-fabricated armor layer 10 comprises a plurality of armor elements 20 which are bonded to a flexible carrier grid 30 using a bonding substance 40, the armor elements being arranged on the carrier grid in a predetermined pattern.

Referring to FIG. 2, each armor element 20 is in the form of a cylindrical pellet 22 having a diameter and a height. The pellet 22 has a convex front end surface 24, a flat rear end surface 26, and a surrounding side wall 28 extending between the front surface 24 and the rear surface 26 along a longitudinal axis 'X'.

Reverting to FIG. 1, the carrier grid has mutually intersecting lines 32 forming cells 36 and is characterized by an interval size (IS) defined by the minimal distance between two adjacent parallel lines 32, and by a density DS defined by the number of cells 36 per unit length of the grid. The interval size IS may for example be in the range of 2÷5 mm, with the density DS being of 6÷3 lines per cm, or 5÷2 cells per cm.

The lines 32 of the carrier grid 30 are made of fibers, e.g. they may be fiberglass strands 34, having a high tensile strength and being capable of being rather easily cut. The high tensile strength is required to allow the carrier grid 30, when held at two opposite edges 35 thereof to carry the weight of the armor elements bonded thereto, without being plastically deformed. For example, the tensile strength may be such that the carrier grid 30 will bear the weight of at least 35 Kg per one meter of the semi-fabricated layer 10. It should be understood that the fibers may be made not only from fiberglass, but also from e.g. Carbon fiber, Aramid, as well as Boron-Carbide, Silicon-Carbide and Silicon-Nitride fibers etc.

Figure 3A:
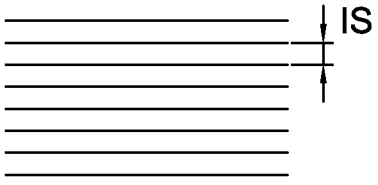
FIGS. 3A to 3D are schematic illustrations of examples of grid patterns of a carrier grid which may be used in a semi-fabricated armor layer according to other embodiments of the present invention.
Figure 3B:
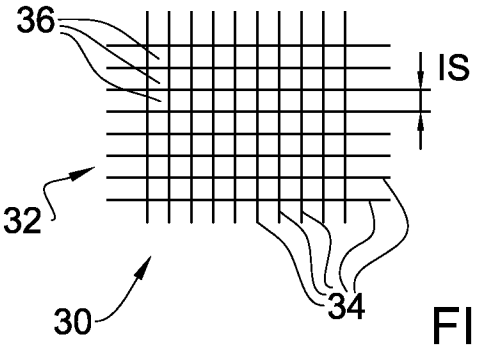
Figure 3C:
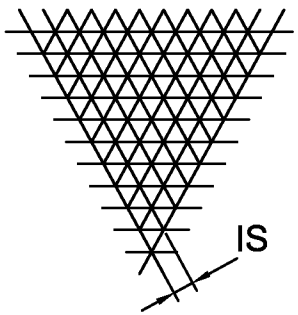
Figure 3D:
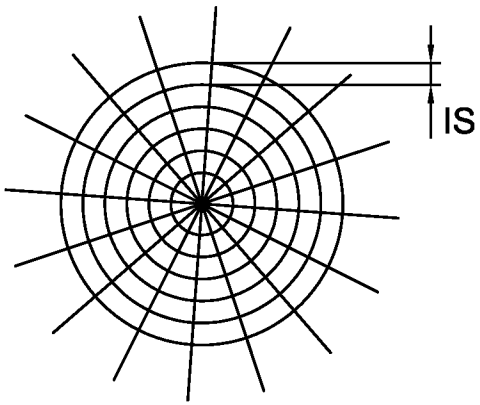

With reference to FIGS. 3A to 3D, examples of carrier grids are shown, which may be used instead of the carrier grid 30, and which have grid patterns different from that of the carrier grid 30. FIG. 3A represents a uni-directional grid pattern, FIG. 3B represents a rectangular warp & weft grid pattern, FIG. 3C represents a triangular grid pattern and FIG. 3D represents a circular grid pattern.

Figure 4:
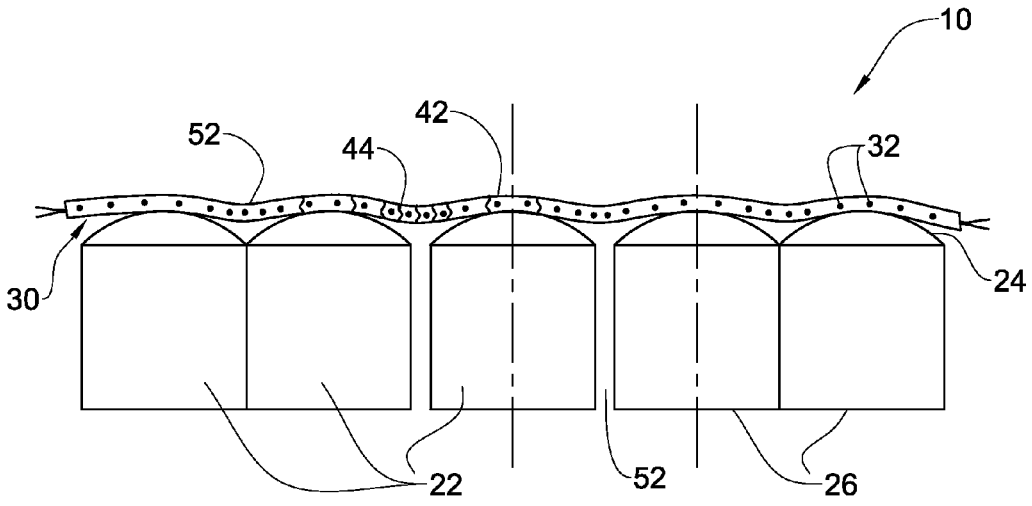
FIG. 4 is a schematic side view of the semi-fabricated armor layer of FIG. 1.

Reverting to FIG. 1 and with reference to FIG. 4, the pellets 22 are bonded to the carrier grid 30 at their front surfaces 24 with a contact area 42 thereof, being intersected, depending on the IS and DS of the grid, by at least one, in particular at least two, and still more particularly by at least four but no more than six lines of the grid 30 (in each direction—horizontal and vertical).

In production of the semi-fabricated layer 10, the pellets 22 are first arranged on a planar support (not shown) in a predetermined desired pattern, in a free-standing position, on their rear end surfaces 26. The carrier grid 30 is then placed over the pellets 22 with bonding substance therebetween to come in contact with their front end surfaces 24 thereof. If the bonding substance is in the form of a powder, a bonding process is performed. The structure comprising the pellets 22, the carrier grid 30 and the bonding substance 40 then undergoes a bonding process, being subjected to an elevated pressure and temperature, e.g. the pressure of 1÷5 Bar and the temperature of 100÷200° C. during which the pellets 22 are bonded to the carrier grid 30 by the bonding substance 40. Before placing the carrier grid 20 and the bonding substance 40, a primer (not shown) may be applied to the pellets 22 for better bonding of the bonding substance 40 to the pellets 22.

Due to the convex front end surface 24 of the pellets 22, gaps 50 are formed between the contact areas 42 of the front end surfaces 24 of adjacent pellets, in which the carrier grid 30 does not contact a certain portion of the front surface 24 of the pellets 22. In addition, the side walls 28 of the pellets do not necessarily contact each other, forming further gaps 52 between the pellets 22, preventing more areas of the carrier grid 30 from coming in contact therewith. The aforementioned areas in which there is no direct contact of the carrier grid 30 with the pellets 22, inter alia, facilitate the flexibility of the semi-fabricated armor layer 10 as will be explained in detail below. Furthermore, the semi-fabricated armor layer 10 may be made with functional openings, such as e.g. 54 depending on the final shape of the armor panel to be produced using the semi-fabricated armor layer 10.

After the bonding process, the carrier grid 30 becomes embedded within the bonding substance 40, while the latter clings to the convex surface 24 of the pellets 22. This defines the contact areas 42 where the bonding substance 40 bonds the pellets 22 to the carrier grid 30.

Figure 7:
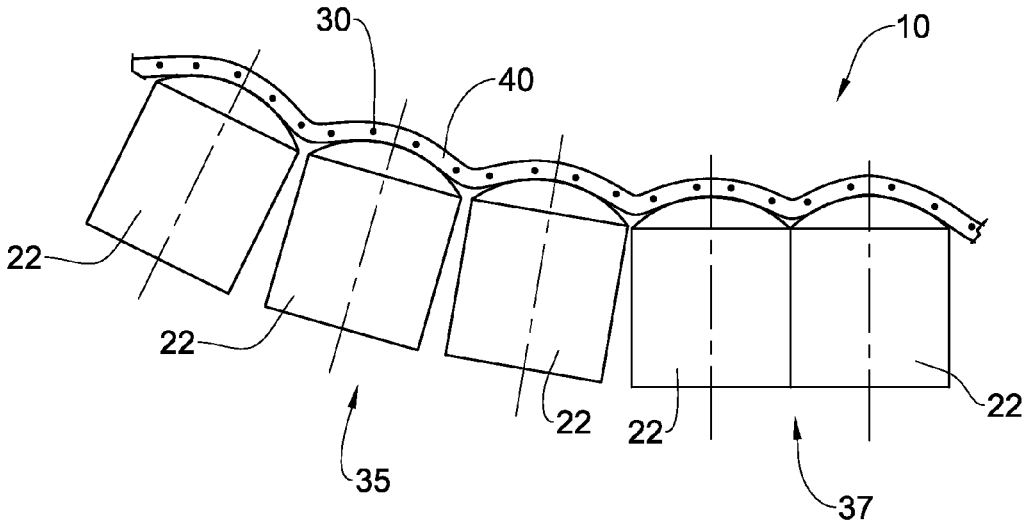
FIG. 7 is a schematic side view of the semi-fabricated armor layer of FIG. 1 when bent.

The semi-fabricated armor layer 10 is substantially flexible, so that, when said carrier has a planar orientation, the pellets have their height axes essentially parallel to each other as shown in FIG. 1, and when the carrier is at least slightly bent, as for example shown in FIG. 7, portion 35 of the layer 10 has its orientation different from that of portion 37 thereof, due to which the height axes of the pellets of the portion 35 are inclined relative to the height axes of the pellets of the portion 37.

Figure 5:
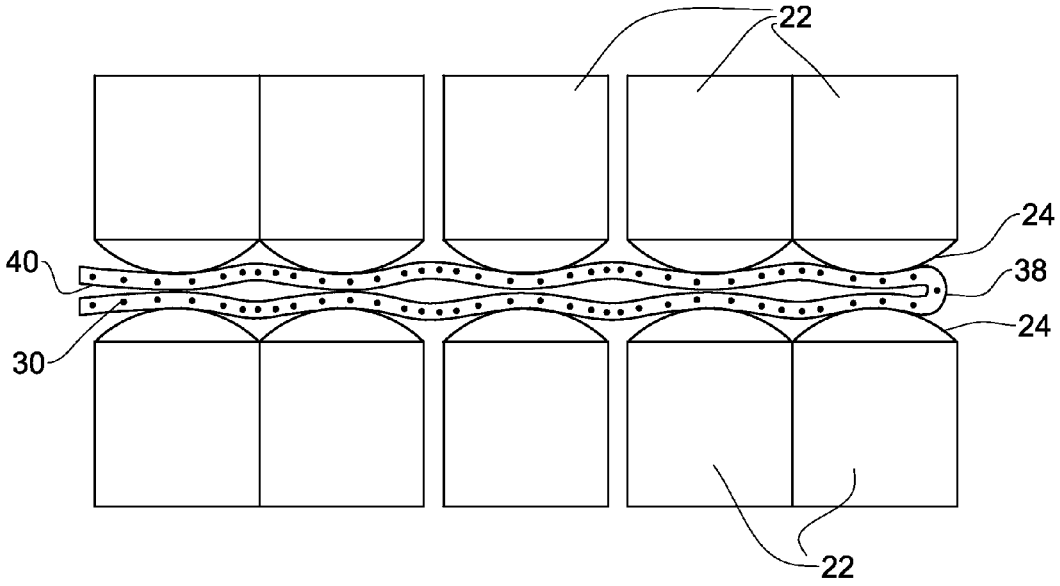
FIG. 5 is a schematic side view of the semi-fabricated armor layer of FIG. 1 when in a folded state.

Referring to FIG. 5, the semi-fabricated layer may be folded, e.g. along a folding line 38 passing between the pellets. It should be noted that the folding line 38 is not predetermined and the semi-fabricated armor layer 10 may be folded in any desirable point and direction, along a folding line 38 passing between front faces 24 of the pellets 22. As shown in FIG. 5, in the semi-fabricated armor, when folded, the front end surfaces 26 of the pellets 22 face each other, and the rear end surfaces 26 face away from each other. In this position, the semi-fabricated armor layer 10 may be folded over and over for more space-efficient storage, and may remain in such folded state until it is required for the manufacture of an armor panel. Furthermore, since the carrier grid 30 is adapted to be easily cut, as mentioned above at any time after the production of the semi-fabricated armor layer 10, the layer may be cut between the pellets, allowing the shaping of the semi-fabricated armor layer 10 into substantially any desired shape. Alternatively, the semi-fabricated layer may be produced with any desired shape, for example as modular units which may be used as described below.

Figure 6A:
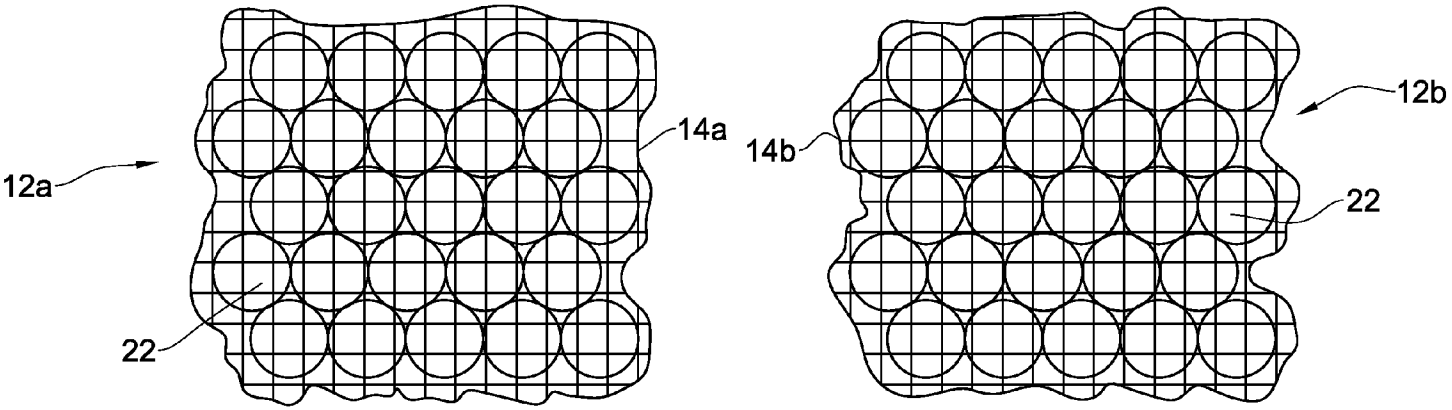
FIGS. 6A and 6B are schematic top views of two modular units of a semi-fabricated armor layer according to a further embodiment of the present invention in separated and connected positions, respectively.
Figure 6B:
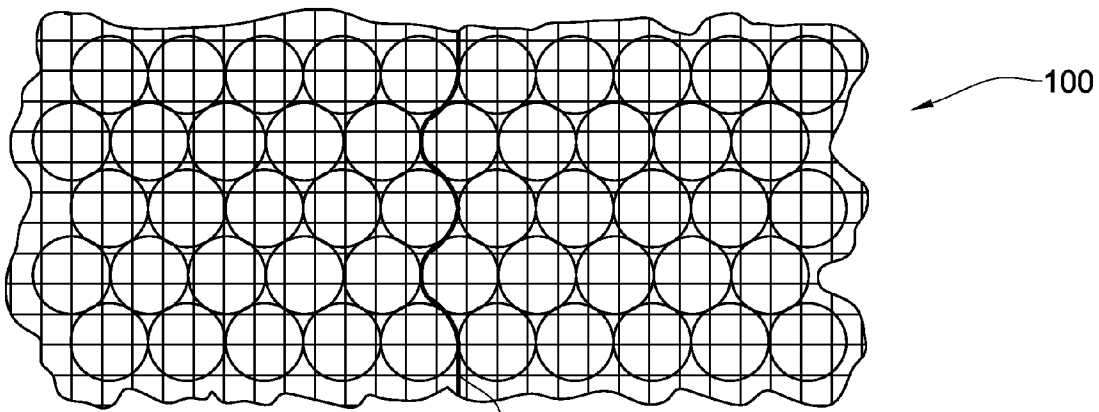

Referring now to FIGS. 6A and 6B, a first and a second modular unit 12*a* and 12*b* are shown, each being produced as the semi-fabricated armor layer 10. The modular units 12*a* and 12*b* each have a connecting edge 14*a*, 14*b* respectively, defined by the pellets 22*a* and 22*b* disposed therealong and edge portions 38*a* and 38*b* of the carrier grid 30. The modular units 12 may be connected along their connecting edges as shown in FIG. 6B.

In order to connect the two modular units 12*a* and 12*b*, the portions 38*a* and 38*b*, of the carrier grid 30, protruding from the connecting edges 14*a* and 14*b* respectively, first need to be cut away or folded in order to allow a proper connection between the modular units 12*a* and 12*b*. The modular units 12*a* and 12*b* may then be connected to form a semi-fabricated armor layer 100 of larger dimensions, which has a uniform tessellated surface, with the connecting edges 14*a* and 14*b* forming a seam line 114.

Figure 8:
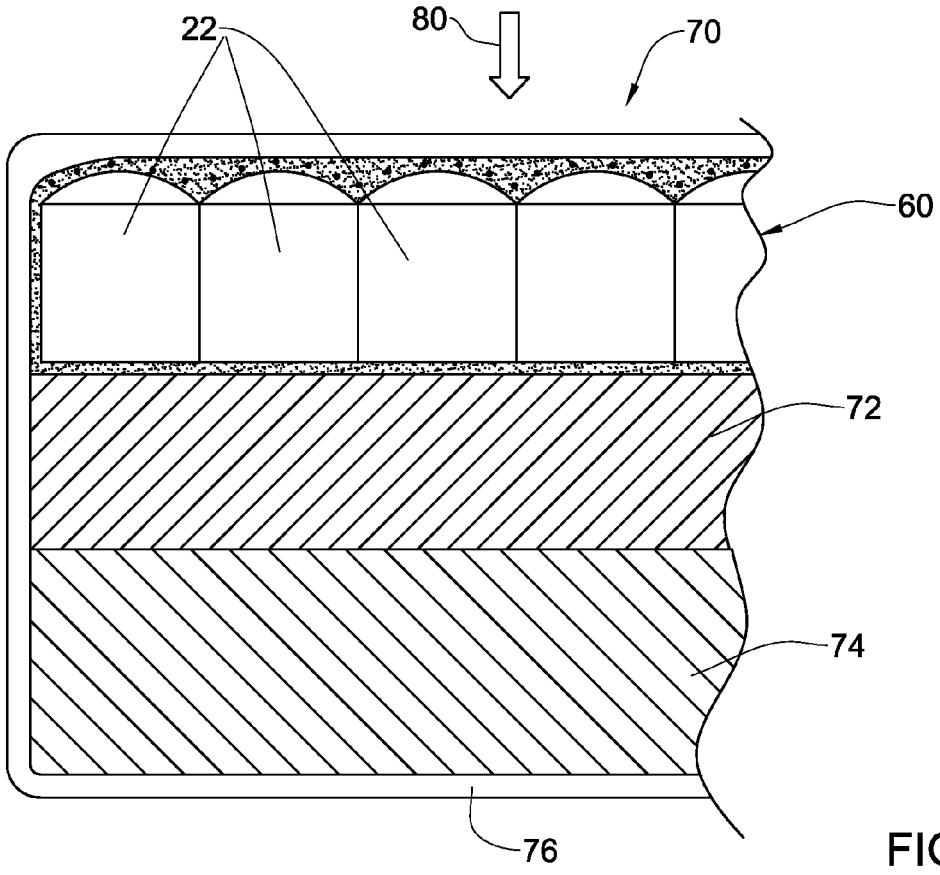
FIG. 8 is a schematic section view of an armor panel including the semi-fabricated armor layer of FIG. 1.

FIG. 8 shows a laminated armor panel 70 comprising main armor layer 60 formed from a semi-fabricated armor layer 10 such as the layer described above, and two additional layers 72, 74, and enclosed by a wrapping 76, which may be in the form of a spoil cover. All the gaps between the different layers of the armor panel 70 are filled with a bonding substance which may be the same as the bonding substance used in the production of the semi-fabricated armor layer 10, for example, a thermoplastic resin.

The armor panel 70 may be produced by a method comprising:

a) providing a mold (not shown) of dimensions corresponding to those of the required armor panel;
b) disposing the mold horizontally;
c) arranging a front layer 76 in the interior of mold and along the side walls to form a cavity having sides and a bottom;
d) placing the semi-fabricated armor layer 10 within the cavity, with the domed front end surfaces 24 of said pellets 22 facing the bottom of the cavity;
e) introducing in the mold additional bonding substance 45 so as to fill all the gaps 50, 52 between the pellets 22 and the bottom and sides of the cavity and to cover the rear end surfaces 26 of the pellets 22;
f) covering the rear end surfaces 26 of the pellets 22 with two backing layers 72, 74; and
g) applying elevated heat and pressure to the mold.

During this process, the additional bonding substance 45 flows through the cells 36 of the carrier grid 30, filling the gaps 50, 52 between the pellets 22 themselves, and between the pellets 22 and the carrier grid 30.

It should be noted that during the manufacturing process of the armor panel 70, due to the spacing IS or density DS, the carrier grid 30 is practically 'transparent' to the bonding substance 45 introduced thereto during such manufacturing, i.e. the additional bonding substance 45 may flow through it freely, an thus the grid does not deteriorate the quality of the bonding.

With regards the backing layer 74, it is made from a ballistic fabric such as aramid (e.g., Kevlar™), fiberglass, polyethylene, or other similar material. It may comprise several sheets of fabric, which may be made of different materials. All sheets may be unidirectional, however the one immediately adjacent the pellets 22 is preferably not, for ballistic reasons.

In the armor panel 70 created using the above process, the domed front surfaces 24 of the pellets 22 are facing the anticipated direction of an incoming projectile (not shown) as designated by arrow 80. It has been shown in tests that directing a domed end towards an incoming projectile produce better ballistic results than directing a planar surface thereto. However, it should be noted here that although in the present example, the carrier grid 30 along with the bonding substance 40 are attached to the domed, front end surface 24 of the pellets 22, they may be alternatively attached to the rear end surface 26 thereof, allowing the semi-fabricated armor layer 10 to be folded outwards, i.e. such that the domed front surfaces 24 of the pellets 22 face away from each other. A semi-fabricated armor layer produced in this way may be used in the manufacturing of armor panels with a considerable curvature, e.g. body armor, breast plates etc.

It is also important to note, that when a semi-fabricated armor layer 10 is manufactured from modular units 12, the bonding substance 45 connects the carrier grids 30*a* and 30*b* of the modular units 12, as well as the pellets 22. In this essence, the seem line 114 does not deteriorate the effectiveness of the armor panel 70 (FIG. 8) incorporating such a plate.

The production of the armor panel 70 as described above may also include an intermediate stage during which an armor plate is first manufactured from the semi-fabricated armor layer 10.

It should further be noted that armor elements 20 may have different cross-sectional shapes of their bodies and different shapes of their front surfaces 24.

Figure 2A:
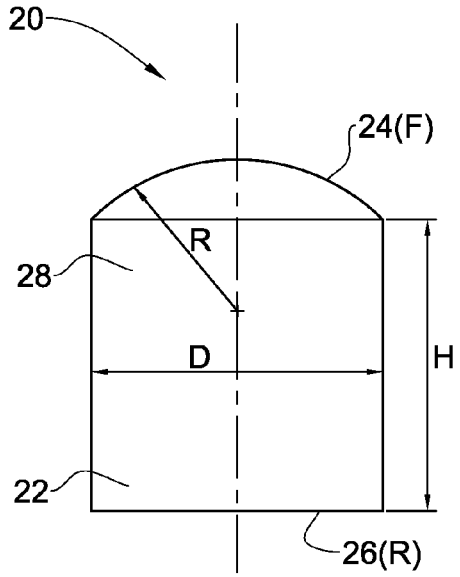
FIG. 2A is a schematic view of one example of an armor element used in the semi-fabricated armor layer of FIG. 1.
Figure 2B:
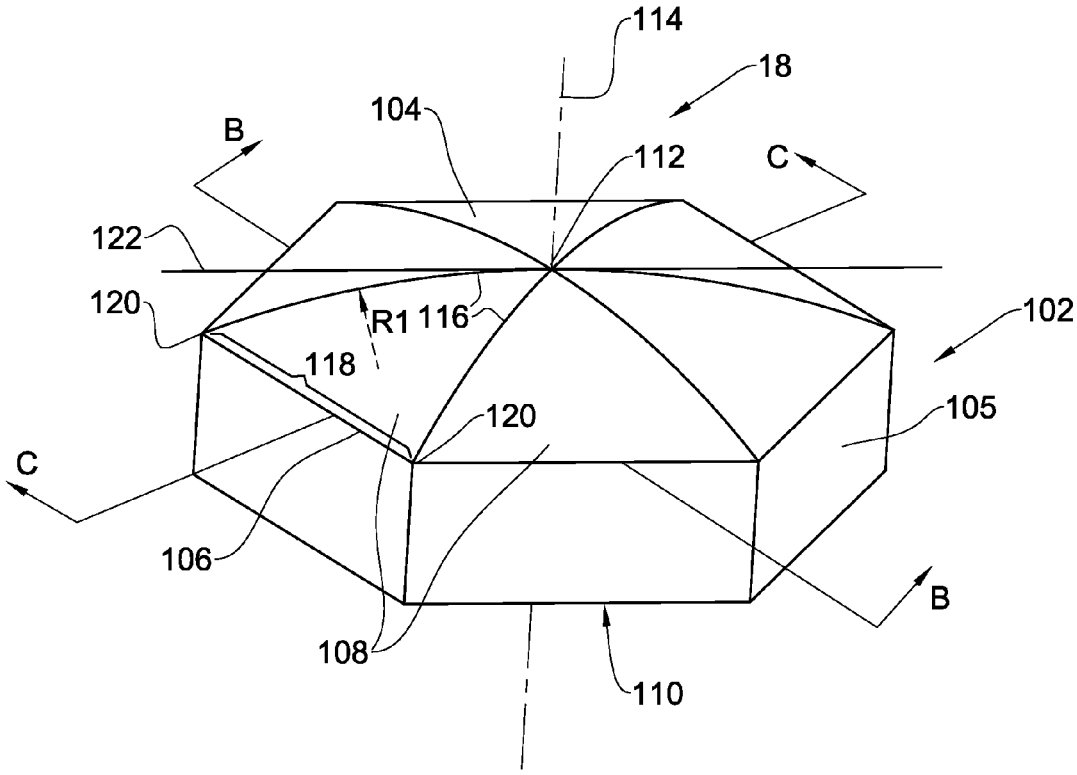
FIG. 2B is a perspective view of another example of an armor element which may be used in the semi-fabricated armor layer of FIG. 1.
Figure 2C:
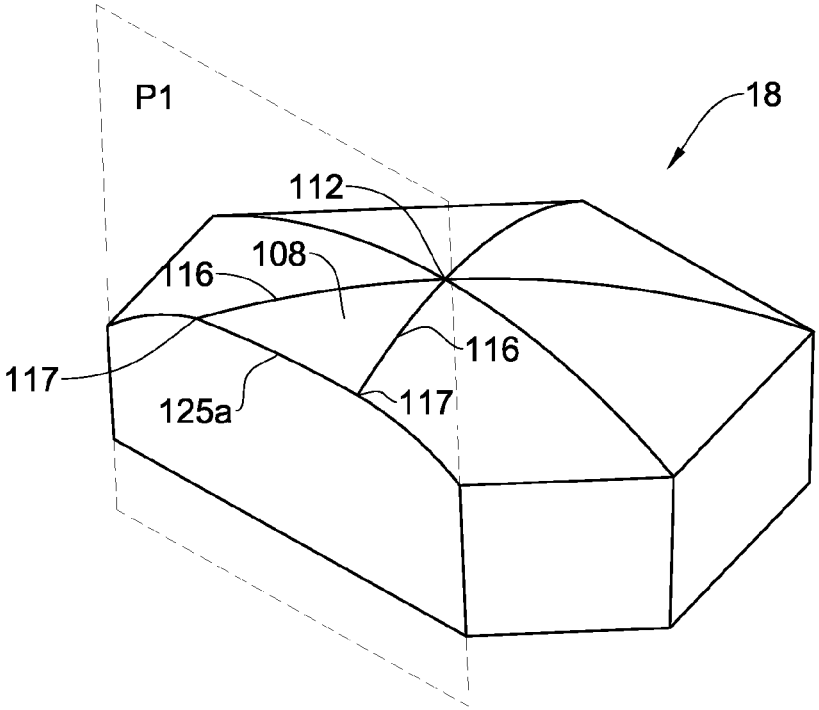
FIG. 2C is a perspective view of the armor element illustrated in FIG. 2B, a portion of which is cut away along plane B-B.
Figure 2D:
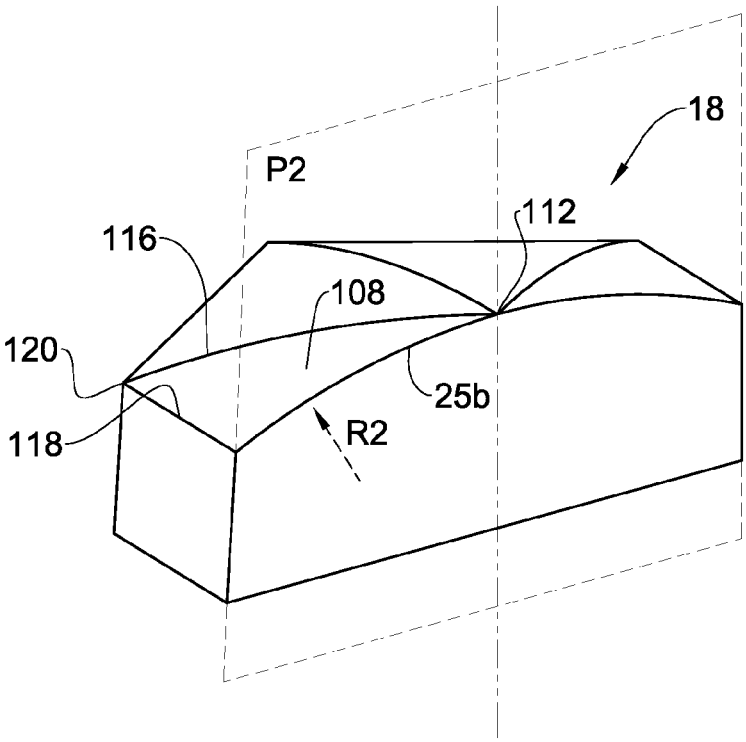
FIG. 2D is a perspective view of the pellet illustrated in FIG. 2B, a portion of which is cut away along plane C-C.

Thus, FIGS. 2B to 2D illustrate a design of armor element 18 alternative to that of armor element 20 shown in FIG. 2A. As seen, the armor element is the form of a pellet generally indicated at 18 having a body portion 102 formed as a hexagonal cylinder, a domed front face 104, with a perimeter line 106 therebetween serving as the boundary between the body portion and the domed front face, and rear face 110, the perimeter line 106 lying in a plane parallel to the rear face 110.

The body portion 102 of the pellet 18 is formed as a hexagonal cylinder with six planar side walls 105. When the pellets 18 are arranged for use in the semi-fabricated armor layer as shown in FIG. 1, with their adjacent side walls 15 facing and aligned with each other, such semi-fabricated layer may be provided with an improved stability both when in a planar state and when folding, due to the aligned pellets supporting each other.

The domed front face 104 comprises six identical sectors 108, which meet at a common juncture point 112 formed at the intersection of the domed front face 104 and an axis of rotational symmetry 114 of the pellet.

Each sector 108 is defined between two convex side edges 116 and base edge 118 constituted by a portion of the perimeter line 106, which extends between two spaced-apart points 120 thereon. Each of the side edges 116 is in the form of a circular arc of radius R1 extending between the juncture point 112 and one of the spaced-apart points 120.

Each sector 108 is formed such that, when the pellet 18 is cut along a plane crossing the side edges 116 e.g., plane P1 shown in FIG. 2C and represented by a line B-B in FIG. 2B, the intersection of this plane with the sector 108 is a straight line extending between the side edges 116, as indicated at 125*a* in FIG. 2C; when the pellet 18 is cut along a plane crossing the base edge 118 e.g. plane P2 shown in FIG. 2D and represented by line C-C in FIG. 2B, the intersection of this plane with the sector 108 is a convexly curved line (albeit having a smaller radius R2 than that of the side edge 116), as indicated at 125*b* in FIG. 2D. Thus, each sector 108 can be described as having the shape of a triangular sheet which is curved in one direction only. The planes P1 and P2 are mutually perpendicular, with the latter being perpendicular to the base edge 118 and bisecting the sector 108, and the former passing through points 117 on the side edges 116, which are equidistant from the juncture point 112.

The sectors 108 are oriented so that lines 122 which are tangent to their side edges 116 at the juncture point 112, lie are parallel to the perimeter line 106.

It will be appreciated that any cross-section of the sector 108 which is taken along a line which is non-parallel to line B-B in FIG. 3A will be a convexly curved line.

The domed front face 104 having the design as described above improves adhesion of the carrier grid 30, and subsequently, of the wrapping 76, to the pellets 18, while retaining the ballistic advantages of domed front face of the pellets. This is due to, inter alia, the fact mentioned above that the shape of each sector 108 can be described as that of a sheet which is curved in one direction only, which is a shape to which sheets can naturally and easily be bent. Thus, each sector is formed so as to naturally conform to the wrapping 76 without resulting in kinks therein, at least locally at each sector 108. These kinks would reduce the amount of area of the wrapping 76 which is in contact with the main armor layer 60. Thus, by reducing the kinks in the wrapping 76, the overall adhesion of the main armor layer 60 thereto is increased, which results in an increased ballistic ability of the composite armor plate.

Those skilled in the art to which this invention pertains will readily appreciate that numerous changes, variations, and modifications can be made without departing from the scope of the invention, mutatis mutandis.

The invention claimed is:

1. A semi-fabricated armor layer for use in production of an armor panel configured to protect a body from an incoming projectile, comprising: a carrier and a plurality of ceramic armor elements each having front and rear end surfaces and a side surface extending therebetween along a height axis of the element, wherein said carrier is flexible and each of a majority of said armor elements is bonded to said carrier along a contact area at one of its end surfaces, is free of such bonding at remaining areas of said one of its end surfaces, and is further free of the bonding to adjacent armor elements at its side surface so that, when said carrier has a planar orientation, at least a majority of the armor elements has their height axes essentially parallel to each other and, when the carrier is at least slightly bent, the height axis of at least one of said elements is inclined relative to the height axis of another of the armor elements adjacent thereto, wherein a ratio between a size of the contact area of the end surface of the ceramic armor elements with which the ceramic armor elements are bonded to the carrier and a size of the end surface is less than 1/1 and not smaller than 1/10.

2. The semi-fabricated armor layer according to claim 1, wherein said carrier has a weight of 100 g/m2.

3. The semi-fabricated armor layer according to claim 1, wherein said carrier has a tensile strength of from about 60 to 140N per five cm wide strap of said carrier.

4. The semi-fabricated armor layer according to claim 1, wherein said carrier is configured to withstand temperatures of up to about 150° C. without undergoing substantial mechanical or chemical changes.

5. The semi-fabricated armor layer according to claim 1, wherein said carrier is a carrier grid in the form of woven or non-woven fiber net.

6. The semi-fabricated armor layer according to claim 5, wherein said carrier grid has no less than three parallel lines per cm.

7. The semi-fabricated armor layer according to claim 1, wherein the amount of bonding substance by which the ceramic armor elements are bonded to the carrier is in the range of from about 30 to 70 g/m2.

8. The semi-fabricated armor layer according to claim 1, wherein at least one of said front and rear end surfaces is either of a circular or of a hexagonal shape.

9. The semi-fabricated armor layer according to claim 1, wherein said front end surface is of a domed shape.

10. The semi-fabricated armor layer according to claim 9, wherein a ratio between a height H of one of the ceramic armor elements and a diameter D thereof is in the range of 1/10 to 2/1.

11. The semi-fabricated armor layer according to claim 1, wherein a ratio between a height H of one of the ceramic armor elements and a diameter D thereof is 1/4 to 4/3.

12. The semi-fabricated armor layer according to claim 1, wherein said semi-fabricated armor layer is foldable along at least one folding line such as to allow its armor elements on two sides of, and adjacent the folding line, to have their surfaces with which the ceramic armor elements are bonded, facing each other.

13. The semi-fabricated armor layer according to claim 1, wherein said semi-fabricated armor layer is flexible enough to be rolled up.

14. The semi-fabricated armor layer according to claim 1, wherein the properties of said carrier allow its cutting thereby allowing to shape said semi-fabricated armor layer into substantially any desired shape.

15. The semi-fabricated armor layer according to claim 1, wherein said semi-fabricated armor layer is produced in the shape of modular units, allowing the future user to construct, using said modular units, a larger semi-fabricated armor layer of a desired shape.

16. The semi-fabricated armor layer according to claim 15, wherein said modular units are constructed such that the ceramic armor elements disposed along an edge of a first modular unit fit together with the ceramic armor elements disposed on an edge of a second modular unit, so that when arranged adjacent each other, they create a uniformly tessellated surface.

17. An armor panel comprising a semi-fabricated armor layer according to claim 1 and a backing layer.

18. The armor panel according to claim 17, further comprising a wrapping containing therein both the semi-fabricated layer and the backing layer.

* * * * *